US008540610B2

(12) United States Patent
Derrick

(10) Patent No.: US 8,540,610 B2
(45) Date of Patent: Sep. 24, 2013

(54) EXERCISE MACHINE

(76) Inventor: John D. Derrick, Transfer, PA (US)

( * ) Notice: Subject to any disclaimer, the term of this patent is extended or adjusted under 35 U.S.C. 154(b) by 257 days.

(21) Appl. No.: 13/019,361

(22) Filed: Feb. 2, 2011

(65) Prior Publication Data

US 2011/0190104 A1 Aug. 4, 2011

Related U.S. Application Data

(60) Provisional application No. 61/300,893, filed on Feb. 3, 2010.

(51) Int. Cl.
*A63B 21/00* (2006.01)

(52) U.S. Cl.
USPC ..... 482/97; 482/10; 482/137

(58) Field of Classification Search
USPC ..... 482/97, 10, 137
See application file for complete search history.

(56) References Cited

U.S. PATENT DOCUMENTS 5,322,489 A * 6/1994 Webb et al. ..... 482/38
5,372,556 A * 12/1994 Ropp ..... 482/41
7,452,311 B2 * 11/2008 Barnes et al. ..... 482/96

* cited by examiner

*Primary Examiner* — Jerome W Donnelly
(74) *Attorney, Agent, or Firm* — The Webb Law Firm, P.C.

(57) ABSTRACT

An exercise machine includes a frame, a body support assembly in pivotable engagement with the frame, and a counter balance assembly connected to the body support assembly, wherein, in operation, the body support assembly is pivotable from a downward position to a top position. The counter balance assembly partially balances a body weight of a user in a prone position against the body support assembly as the body support assembly is pivoted from the downward position to the top position. The counter balance assembly may include a reaction arm extending from a rear portion of the body support assembly and pivotable about the frame, and may include a weight bearing end opposite the body support assembly. A method of using an exercise machine includes positioning a user body prone against a body support assembly, wherein the body support assembly is pivotally engaged with an exercise machine frame and counterbalancing the user's bodyweight.

20 Claims, 7 Drawing Sheets

EXERCISE MACHINE

CROSS REFERENCE TO RELATED APPLICATIONS

This application claims priority to U.S. Provisional Patent Application No. 61/300,893, filed Feb. 3, 2010, the entire content of which is incorporated herein by reference.

BACKGROUND OF THE INVENTION

1. Field of the Invention

The present invention relates to compound exercises and exercise machines, and, in particular, to compound opposite origin exercises and machines therefore.

2. Description of Related Art

An opposite origin exercise is defined as an exercise that works the same muscles as a normal exercise, but do so from an opposite point of origin or insertion. Many exercises can be categorized as opposite origin exercises, and many involve body weight resistance. For example, an opposite origin exercise for a lat pull down exercise using a lat cable machine is a wide grip pull-up. There, an individual will pull his or her body up toward a pull-up bar, as opposed to pulling the weight down toward his or her chest while using a lat cable machine with body weight providing the resistance. Many times, individuals are incapable of performing these exercises because their muscles are not developed enough in order to overcome the resistance provided by their own body weight. Therefore, various machines have been developed to assist users by offsetting user body weight, such as pull-up machines, wherein users kneel on a platform movable in the vertical direction, which is connected to a weight stack via a cable and pulley system. One opposite origin exercise is a reverse leg curl. Normally, while performing a standard standing one leg curl, an individual will move his or her lower legs at the knees against weight resistance toward the gluteus muscle. This exercise works the gluteus and hamstring. In a reverse leg curl, the movement is reversed, wherein the individual will move the upper two-thirds of the body toward the feet and lower legs by bending at the knees, thereby using body weight as resistance. However, this exercise can be particularly difficult to perform, especially in individuals with underdeveloped gluteus muscles and hamstrings. Therefore, a need exists for a machine that can assist a user in performing a reverse leg curl by counter balancing the user's body weight.

SUMMARY OF THE INVENTION

An exercise machine may include a frame, a body support assembly in pivotable engagement with the frame, and a counter balance assembly. The counter balance assembly is connected to the body support assembly, wherein, in operation, the body support assembly is pivotable from a downward position to a top position. The counter balance assembly partially offsets a body weight of a user in a prone position against the body support assembly as the body support assembly is pivoted from the downward position to the top position.

In one embodiment, the counter balance assembly may include a reaction arm extending from a rear portion of the body support assembly and pivotable about the frame, and may include a weight bearing end opposite the body support assembly. The weight bearing end may be adapted to receive weights directly thereon. When the body support assembly is in the downward position, the weight bearing end is in a raised position providing a counter balance to the user body weight. The weight bearing end may be pivotally attached to the reaction arm, wherein the weight bearing end is angularly adjustable with respect to the reaction arm between a plurality of angular positions. Alternatively, the counter balance assembly may include a cable and pulley system having a pulley, a weight stack, and a cable running from the weight stack over the pulley and to the weight bearing end of the reaction arm. When the body support assembly is in the top position, the weight stack is in a lowered position, and when the body support assembly is in the downward position, the reaction arm lifts the weight stack to a raised position providing a counter balance to the user body weight.

The body support assembly may include a chest pad assembly. In one embodiment, the chest pad assembly may include a chest pad, an adjustment member, and a chest pad frame, wherein the adjustment member is attached to a rear side of the chest pad and is in slidable engagement with the chest pad frame, such that the chest pad can be positioned by varying distances from the chest pad frame.

The exercise machine may further include a knee pad assembly which is connected to the frame, and the body support assembly, and, alternatively, the chest pad assembly may be in pivotable engagement with the knee pad assembly. The knee pad assembly may be angularly adjustable between a plurality of angular positions, for example, between 90° and 45° in relation to a horizontally defined plane, with respect to the frame. In operation, the knee pad assembly may be fixedly secured in one of the plurality of angular positions. A pivot bar may extend through a rear portion of the body support assembly and a bottom portion of the knee pad assembly defining an axis of rotation therebetween. In operation, then, the body support assembly may pivot about the knee pad assembly via the pivot bar. If the counter balance assembly includes a reaction arm, the reaction arm may extend from the body support assembly at a point on the axis of rotation defined by the pivot bar.

The exercise machine frame may include an elevated platform. The knee pad assembly may be attached to a front edge of the platform. The frame may also include a base frame member, two side frame members, and a knee pad mounting bar. The side frame members may be positioned on opposite sides of the base frame member and extend in an upward direction. The knee pad mounting bar may extend between the two side frame members and across the front edge of the platform with the knee pad assembly being attached to the knee pad mounting bar. A toe and heel support may also be attached to a top portion of the knee pad assembly.

A method of performing an exercise may include the steps of orienting a user body prone against a body support assembly of an exercise machine frame, wherein the body support assembly is pivotally engaged with the frame; positioning a user's legs, such that a lower portion of the user's legs below the knee are stationary; counterbalancing a user's body weight via a counter balance assembly attached to the body support assembly of the exercise machine frame; and moving the user's body from a downward position to a top position by pivoting the body support assembly from a downward position to a top position about the exercise machine frame via the user's knees. Positioning a user's legs may include positioning the lower portion of the user's legs and knees against a knee pad assembly which is attached to the frame. After the step of moving the user's body from a downward position to a top position, the user's body may be moved from the top position to the downward position by pivoting the body support assembly from the top position to the downward position about the exercise machine frame via the user's knees. Counter balancing the user's body may include the step of offsetting the user's body weight by adding weight resistance to a weight bearing end of a reaction arm extending away from the body support assembly. The weight bearing end may be opposite the body support assembly.

BRIEF DESCRIPTION OF THE DRAWINGS

The invention may be more completely understood in consideration of the following drawing figures and description wherein like reference numbers identify like parts throughout.

DESCRIPTION OF THE PREFERRED EMBODIMENTS

Figure 1:
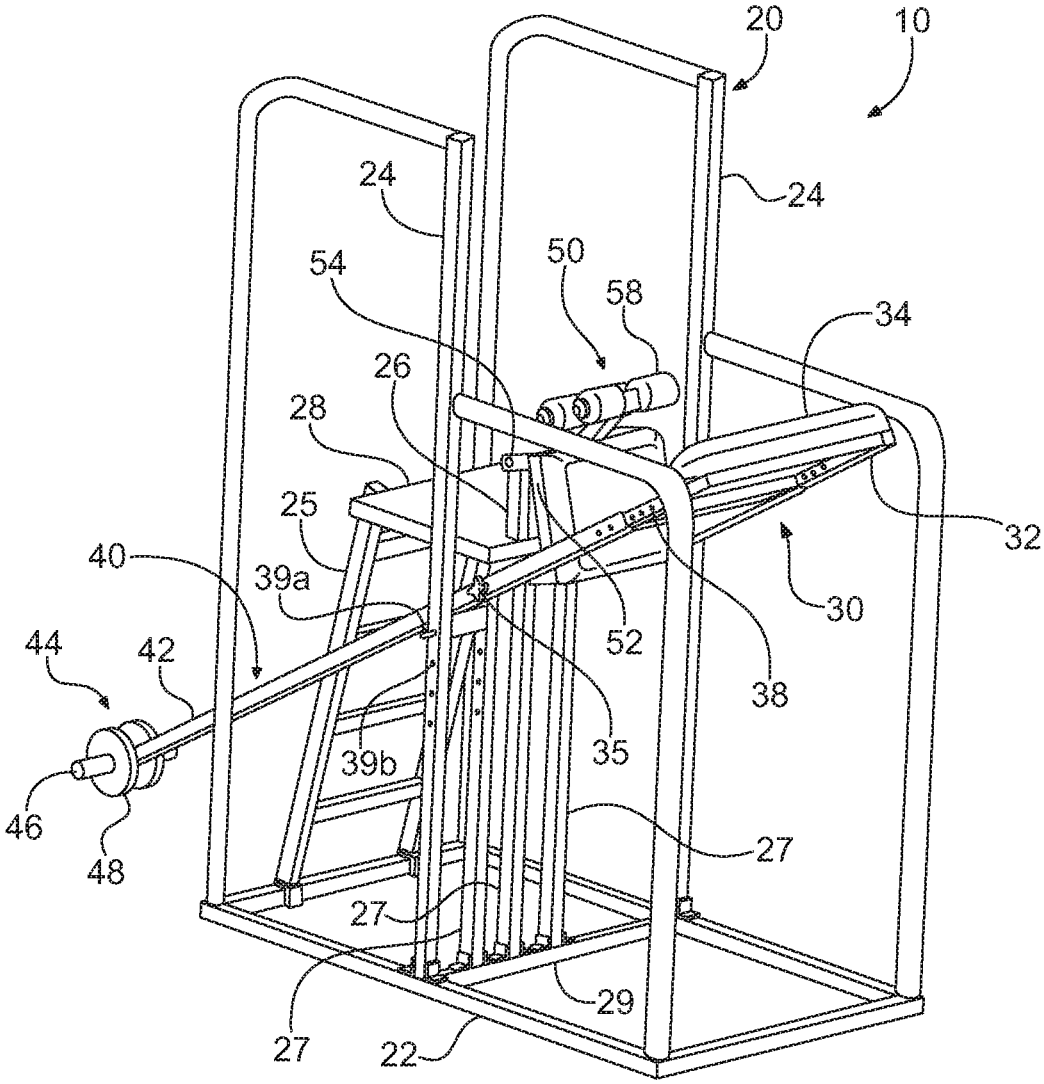
FIG. 1 is a perspective view of an embodiment of an exercise machine.

For purposes of the description hereinafter, spatial orientation terms, if used, shall relate to the referenced embodiment as it is oriented in the accompanying drawing figures, or otherwise described in the following detailed description. However, it is to be understood that the embodiments described hereinafter may assume many alternative variations and embodiments and that the specific embodiments illustrated in the accompanying drawing figures and described herein are simply exemplary and should not be considered as limiting.

Referring first to FIGS. 1-4, an exercise machine 10 may generally include a frame 20, a body support assembly 30, and a counter balance assembly 40. The body support assembly 30 and counter balance assembly 40 may be pivotable with respect to the frame 20 at a pivot point 35.

Figure 6A:
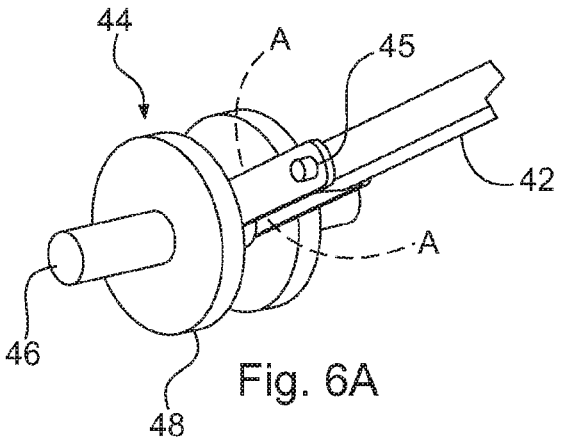
FIG. 6A shows an embodiment of a weight bearing end of a counter balance assembly of the exercise machine of FIG. 1.
Figure 6B:
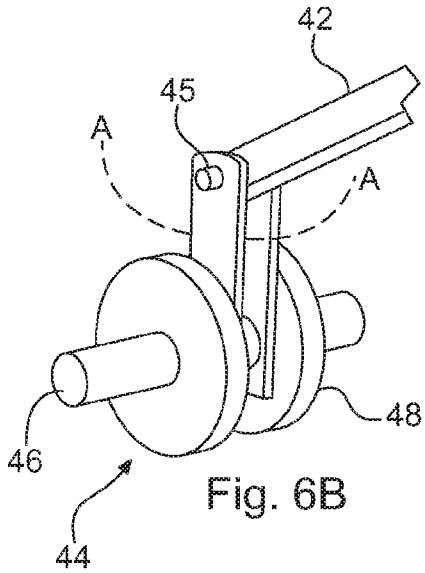
FIG. 6B shows the weight bearing end of FIG. 6A in a different angular position.

As shown, the counter balance assembly 40 may include a reaction arm 42, which extends from the rear portion of the body support assembly 30. The reaction arm 42, being part of counter balance assembly 40, is also pivotable about the frame 20 and may include a weight bearing end 44, which is opposite the body support assembly 30. As illustrated in FIGS. 1-4, the weight bearing end 44 is adapted to receive weights directly thereon. The weight bearing end 44 may, for example, include tubing 46, which can receive weights 48, such as Olympic-style weights. Tubing 46 can be metal tubing, such as two inch round aluminum tubes. Referring now to FIGS. 6A and 6B, the weight bearing end 44 of reaction arm 42 may optionally be pivotable with respect to the reaction arm 42 by, for example, a hinge 45. In this embodiment, the weight bearing end 44 may be angularly adjustable with respect to the reaction arm 42 between a plurality of angular positions from a position extending completely outward from and parallel to reaction arm 42, indicated in FIG. 6A, to any position along broken line A, such as that indicated in FIG. 6B. The hinge 45 of adjustable weight bearing end 44 may be lockable, such that weight bearing end 44 does not pivot about hinge 45 while in use, thereby maintaining a constant angular position with respect to reaction arm 42.

Figure 8:
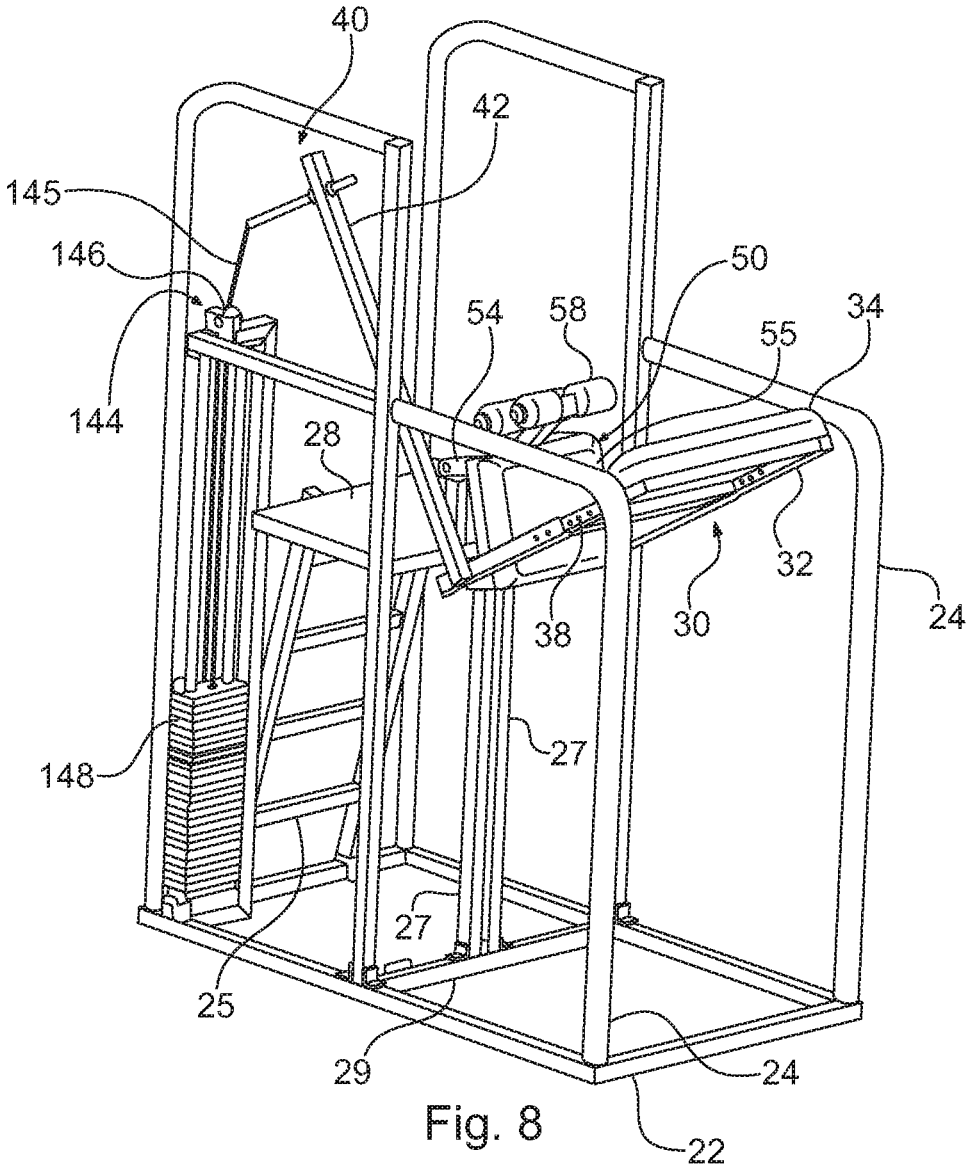
FIG. 8 shows an embodiment of an exercise machine including a cable and pulley system.

Referring now to FIG. 8, the counter balance assembly 40 may alternatively include a cable and pulley system 144. Counter balance assembly 40 includes reaction arm 142, which is connected to a cable 145, which runs over a pulley 146, which is capable of lifting weights from weight stack 148 via a lifting rod. The weights in the weight stack 148 may be a plurality of ten pound plates. In use, when a user is in a downward position, the reaction arm 42 will rotate with the body support assembly 30, thereby pulling weights from weight stack 148 upward with the weight stack 148 counter balancing the user's body weight. In this embodiment, reaction arm 42 may be welded to chest pad frame 32, at an angle as shown, so that chest pad frame 32 and reaction arm 42 are fixedly secured to each other.

Referring now again to FIGS. 1-4, the exercise machine frame 20 may include a base frame 22, two side frames 24, which may extend in an upward direction from the base frame 22, and a knee pad mounting bar 26. The knee pad mounting bar 26 may be connected to an elevated platform 28. As best illustrated in FIGS. 3-5, the frame 20 may include two knee pad mounting bars 26. The knee pad mounting bar 26 may be positioned on a front edge of the platform 28, with the platform being supported by two vertical bars 27 extending downwardly to a base cross bar 29, which attaches to and extends between the base frame 22. The frame may also include a ladder 25 attached to a rear portion of platform 28. Attached to the knee pad mounting bar 26 is a knee pad assembly 50. The knee pad assembly 50 may include a knee pad 55 attached to a knee pad frame 52, which includes rear extensions 54, which are attached to knee pad mounting bar 26. The knee pad assembly 50 may also include adjustable toe and heel pads 58 between which a user's feet are secured during use. A steel bar 56 may extend through extensions 54 and knee pad mounting bar 26, thereby connecting the knee pad frame 52 to knee pad mounting bar 26. The knee pad assembly 50 may be positioned at any angular position, for example, a 75° angle to a horizontal plane, and the knee pad assembly 50 may permanently secured in that angular position. However, alternatively, referring to FIGS. 4 and 5, the knee pad assembly 50 may also be adjustable between a plurality of angular positions between, for example, between 90° and 45° or between 90° and 0° to a horizontal plane, wherein at 0° the knee pad assembly 50 would be parallel to the ground. As shown in FIG. 5, the angle of the knee pad assembly 50 is less than the angle shown in FIG. 4. The knee pad mounting bar 26 may permit the knee pad assembly 50 to be angularly adjustable with respect to the frame 20 and/or platform 28, such that knee pad assembly 50 pivots about mounting bar 26. The knee pad assembly 50 may then be fixedly secured in any of the plurality of angular positions by way of a removable pin and adjustment bar connected under a front part of the knee pad assembly 50. The adjustment bar may be a curved piece of 1½ inch metal tubing which is mounted to a bottom portion of the knee pad frame 52 which extends between vertical bars 27, wherein a the pin extends through apertures defined through the adjustment bar and vertical bars 27 to fixedly secure the knee pad assembly 50 in place. Such an arrangement will allow the knee pad assembly 50 to be fixedly secured during use between any number of positions.

Figure 2:
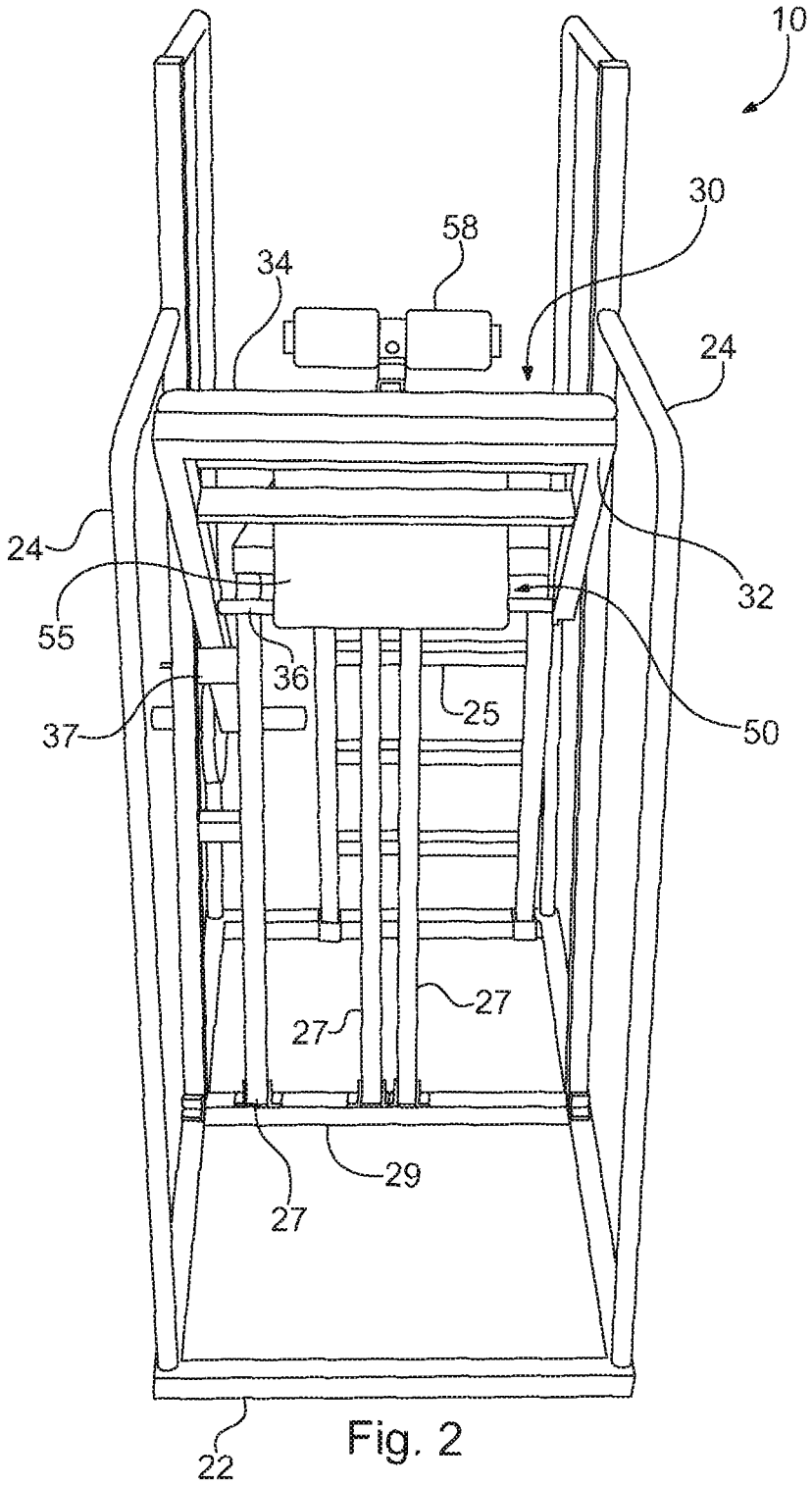
FIG. 2 is a front view of the exercise machine of FIG. 1.
Figure 3:
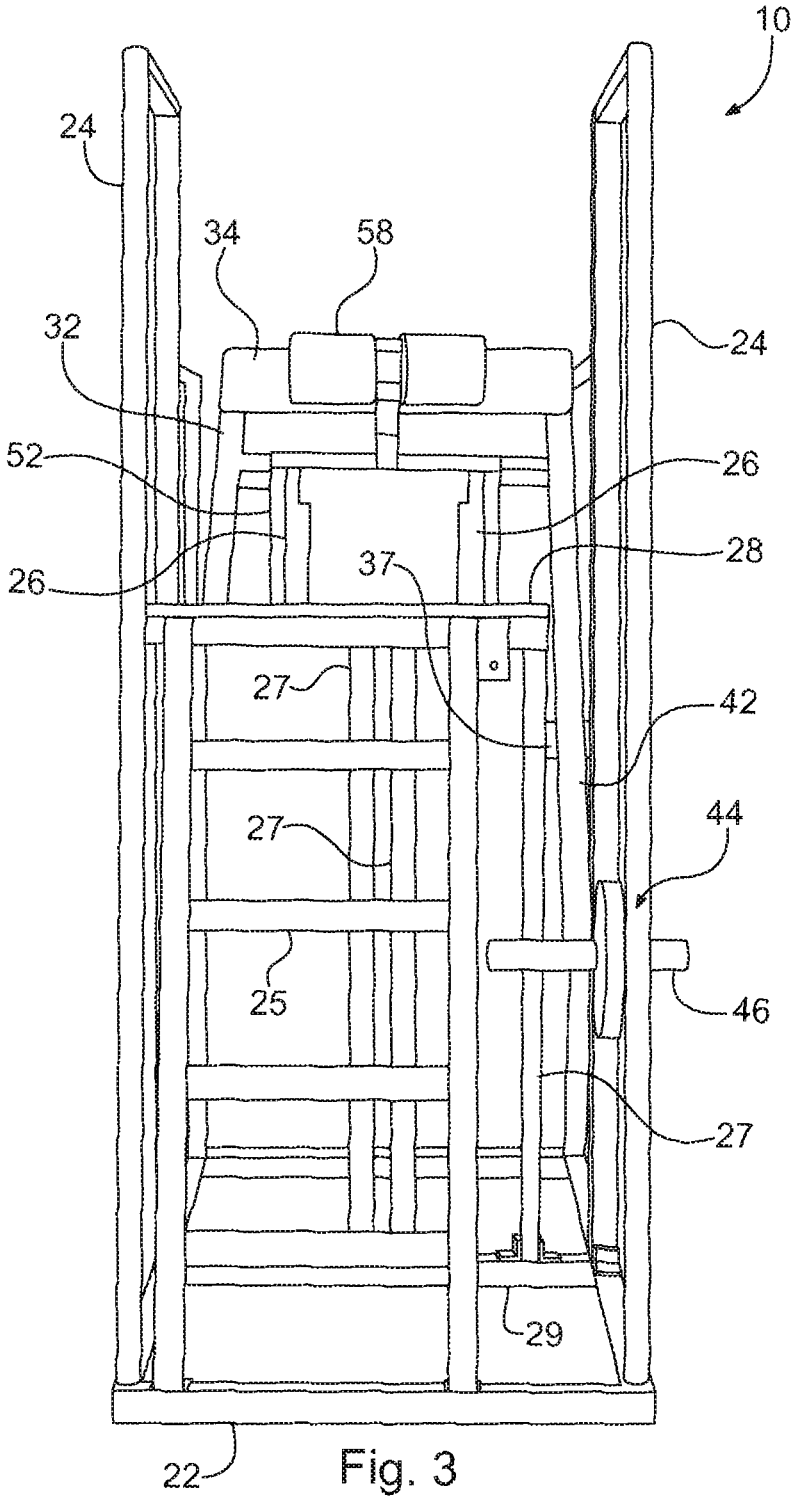
FIG. 3 is a rear view of the exercise machine of FIG. 1.
Figure 4:
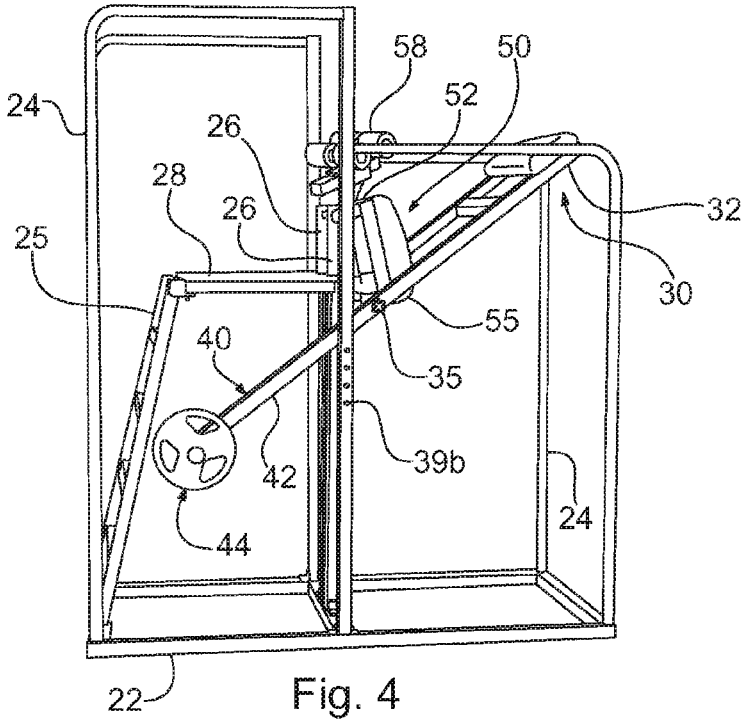
FIG. 4 is a side view of the exercise machine of FIG. 1.
Figure 5:
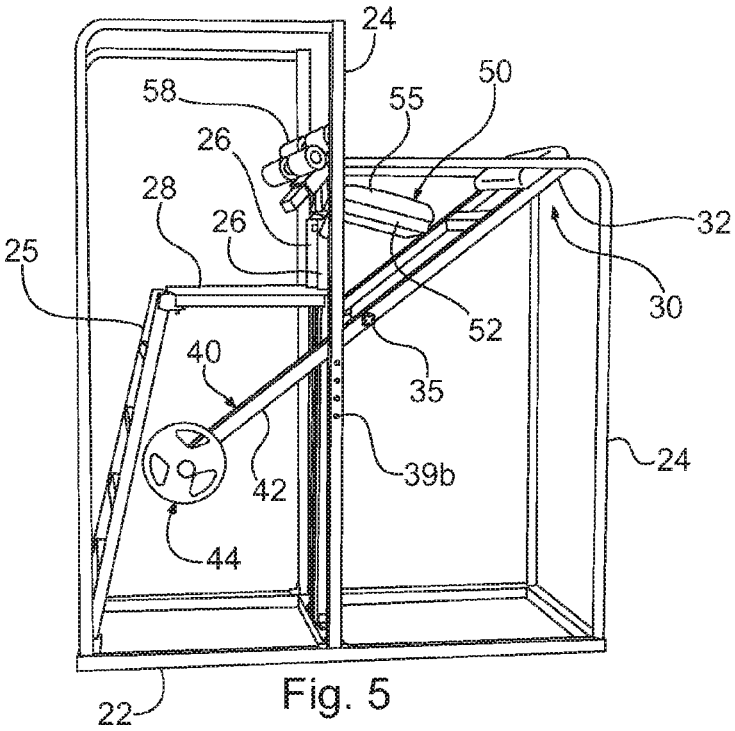
FIG. 5 is an alternative side view of the exercise machine of FIG. 1 showing angular displacement of a knee pad assembly.

The body support assembly 30, shown in FIGS. 1-4, may be, for example, a chest pad assembly having a chest pad frame 32 to which a chest pad 34 is attached. The body support assembly 30 may also include a pivot bar 36, as best shown in FIG. 2, extending through a rear portion of the body support assembly 30 and a bottom portion of knee pad assembly 50, thereby defining an axis of rotation between body support assembly 30 and knee pad assembly 50. The pivot bar 36 may extend through chest pad frame 32 and knee pad frame 52 via cylinder fittings positioned therethrough. The pivot bar 36 allows the body support assembly 30 to pivot about knee pad assembly 50 during operation of exercise machine 10, and corresponds to pivot point 35 on body support assembly 30. As shown, the reaction arm 42 of counter balance assembly 40 may be an extension of chest pad frame 32, which extends from pivot point 35 in a rearward direction.

Also, the chest pad frame 32 may be vertically adjustable to account for variations in a user's height. For example, chest pad frame 32 may be adjustable to various vertical positions indicated by adjustment holes 38 on chest pad frame 32. The chest pad frame 32 may be in slidable engagement with reaction arm 42, such that chest pad frame 32 may be slidably adjusted to any of the positions indicated by adjustment holes 38.

As best shown in FIGS. 1-3, the frame 20 may also include a stopper pad 37 which provides a limit on the amount of angular/pivotable displacement of chest pad assembly 30 and reaction arm 42. For example, in an unused state, reaction arm 42 will pivot to a downward position and chest pad assembly 30 will pivot to an opposite upward position until reaction arm 42 contacts stopper pad 37. In an opposite position, when the exercise machine 10 is being used and the chest pad assembly 30 is in a downward position, with reaction arm 42 in an upward position, the chest pad frame 32 will contact stopper pad 37 at its lowest point, thereby preventing chest pad assembly 30 and reaction 42 from pivoting any further. The stopper pad 37 may be constructed of any material suitable to withstand the repeated contact of reaction arm 42 and chest pad assembly 30. Also, referring to FIGS. 1, 4, and 5, stopper pad 37 may be vertically adjustable via a removable pin or bolt 39*a* and adjustment holes 39*b*, wherein the bolt 39*a* would extend through side frame 24, stopper pad 37, and a vertical bar 27. The lower stopper pad 37 is positioned, the greater the amount of allowed angular displacement of chest pad assembly 30 and reaction arm 42. For example, in an unused state with chest pad assembly 30 in the upward position, chest pad assembly 30 will be closer to vertical, the lower stopper pad 37 is positioned.

Figure 7:
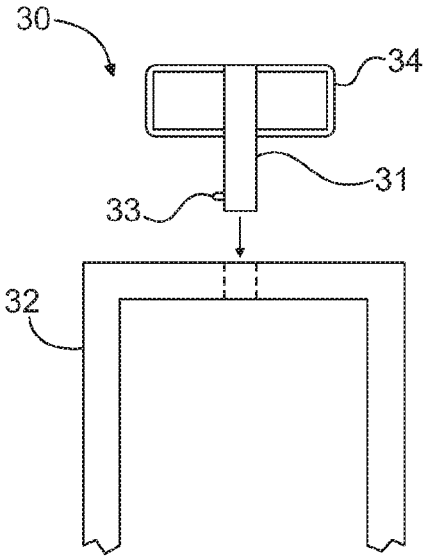
FIG. 7 shows an embodiment of a chest pad assembly.

Referring now to FIG. 7, in an alternative embodiment, the chest pad frame 32 may include an adjustment member 31, which is attached to a rear portion of the chest pad 34. The chest pad frame 32 may optionally be attached to a wood plate, which may, for example, be twenty inches, which, in turn, may be attached to 3/16 or ¼ inch plate aluminum. The adjustment member 31 may then be attached to a rear portion of the plate aluminum. The adjustment member 31 is in slidable engagement with the chest pad frame 32 and may be adjustable to various positions via an adjustable spring loaded pin or plunger pin 33. The chest pad frame 32 may include, for example, two inch square metal tubing whereas adjustment member 31 may include 1 ¾ inch square tubing so as to be able to be in slidable engagement with chest pad frame 32.

In general, the construction of exercise machine 10, including frame 20, body support assembly 30, and counter balance assembly 40 may include metal tubing sections, such as two by two or two by four metal tubing. The tubing sections could then be welded and/or bolted together.

Figure 9:
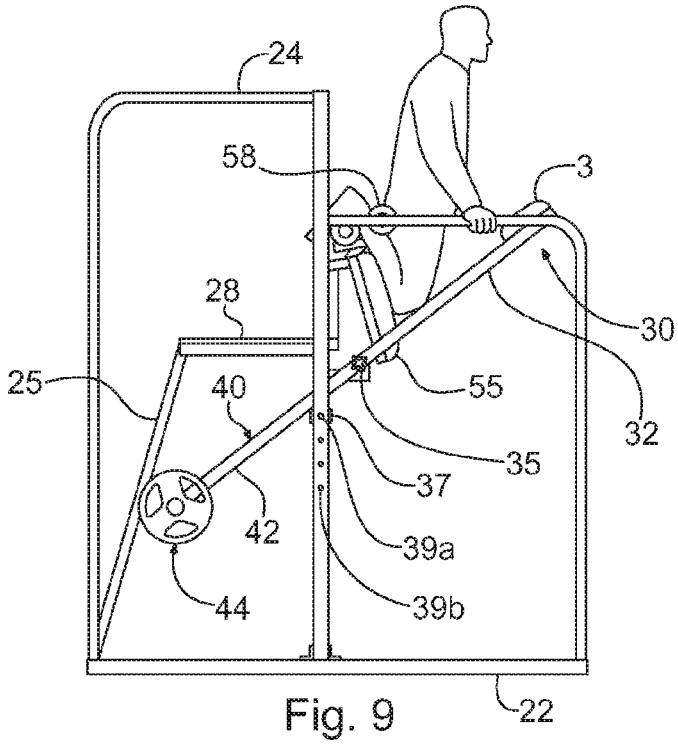
FIG. 9 shows a user positioned on the exercise machine of FIG. 1.
Figure 10:
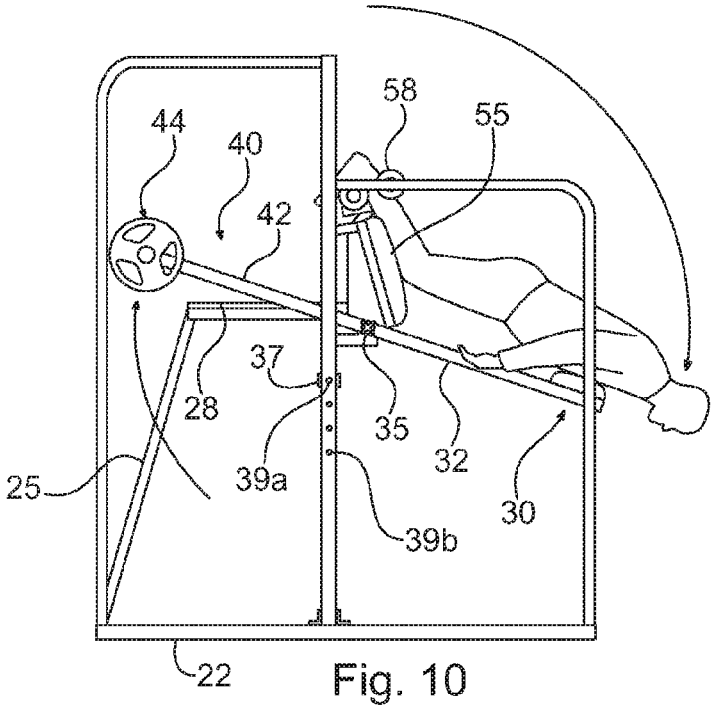
FIG. 10 shows the exercise machine of FIG. 1 in use.

Referring now to FIGS. 9 and 10, in use, a user would secure their feet between toe and heel pad 58 with their knees and shins being positioned against knee pad 55, thereby maintaining the lower legs and knees of the user in a stationary position. The user would then orient his or her body prone against the body support assembly 30. The user's body weight will force the body support assembly 30 to pivot to a downward position with the counter balance assembly 40 pivoting to an opposite upward position, as shown in FIG. 10. The user will then pivot his or her body and body support assembly 30 by pulling the top two-thirds of the body, including the torso, up at the user's knees toward the lower portion of the user's legs positioned against the knee pad assembly 50, The counter balance assembly 40 will offset the user's body weight because with weight bearing end 44 of counter balance assembly 40 being in an upward position, gravity will act to pull the weight downward, thereby assisting the user to complete the motion. Upon completion of the motion, the user's head will be pointed toward the ceiling. This motion will provide tension in the user's hamstring and gluteus muscles, which upon release of that tension, the user's body weight will again force the body support assembly 30 downward and the counter balance assembly 40 upward.

When using the embodiment of weight bearing assembly 44, including a hinge 45, as noted above, the weight bearing assembly 44 is pivotable between a completely outward position wherein the weight bearing assembly 44 is parallel to reaction arm 42 and a plurality of other angular positions along broken line A. In use, the hinge 45 may be locked in any of such plurality of angular positions, or may be unlocked so that weight bearing assembly 44 may pivot about hinge 45 when in use as reaction arm 42 raises and lowers. When the weight bearing assembly 44 is completely outward parallel to reaction arm 42, less weight will be needed to offset the user's body weight. This is because, generally, the longer the reaction arm 42 is in comparison to the rest of the exercise machine 10, the greater the ability of counter balance assembly 40 is to offset the weight of a user when in use.

While specific embodiments of the above-described exercise machine have been described in detail, it will be appreciated by those skilled in the art that various modifications and alternatives to those details could be developed in light of the overall teachings of the present disclosure. The presently preferred embodiments described herein are meant to be illustrative only and not limiting as to the scope of the invention, which is to be given the full breadth of the appended claims and any and all equivalents thereof.

The invention claimed is:

1. An exercise machine comprising:

a frame;

a body support assembly in pivotable engagement with the frame, the body support assembly comprising a chest pad assembly comprising a chest pad, an adjustment member and a chest pad frame, wherein the adjustment member is attached to the chest pad and is in slidable engagement with chest pad frame, such that the chest pad can be positioned at varying distances from the chest pad frame; and a counter balance assembly connected to the body support assembly, wherein, in operation, the body support assembly is pivotable from a downward position to a top position, and the counter balance assembly partially offsets a body weight of a user in a prone position against the body support assembly as the body support assembly is pivoted from the downward position to the top position.

2. The exercise machine of claim 1, wherein the counter balance assembly comprises a reaction arm extending from a rear portion of the body support assembly and pivotable about the frame, wherein the reaction arm includes a weight bearing end opposite the body support assembly, and, wherein when the body support assembly is in the downward position, the weight bearing end is in a raised position providing a counter balance to the user body weight.

3. The exercise machine of claim 2, wherein the weight bearing end is adapted to receive weights directly thereon.

4. The exercise machine of claim 2, wherein the counter balance assembly further comprises a cable and pulley system having a pulley, a weight stack, and a cable running from the weight stack over the pulley and to the weight bearing end of the reaction arm, wherein, when the body support assembly is in the top position, the weight stack is in a lowered position, and, wherein when the body support assembly is in the downward position, the reaction arm lifts the weight stack to a raised position providing a counter balance to the user body weight.

5. The exercise machine of claim 2, wherein the weight bearing end is pivotally attached to the reaction arm, wherein the weight bearing end is angularly adjustable with respect to the reaction arm between a plurality of angular positions.

6. The exercise machine of claim 1, further comprising a knee pad assembly which is connected to the frame, wherein the body support assembly is in pivotable engagement with the knee pad assembly.

7. The exercise machine of claim 6, wherein the knee pad assembly is angularly adjustable with respect to the frame between a plurality of angular positions, wherein, in operation, the knee pad assembly is fixedly secured in one of the plurality of angular positions.

8. The exercise machine of claim 7, wherein the knee pad assembly is adjustable with respect to the frame between a range of 90° to 45° in relation to a horizontally defined plane.

9. The exercise machine of claim 8, further comprising a pivot bar extending through a rear portion of the body support assembly and a bottom portion of the knee pad assembly defining an axis of rotation therebetween, such that, in operation, body support assembly pivots about the knee pad assembly via the pivot bar.

10. The exercise machine of claim 9, wherein the counter balance assembly comprises a reaction arm extending from the body support assembly at a point on the axis of rotation.

11. The exercise machine of claim 6, wherein the frame comprises an elevated platform, the knee pad assembly attached to a front edge of the platform.

12. The exercise machine of claim 11, wherein the frame further comprises a base frame member, two side frame members, and a knee pad mounting bar, the side frame members being positioned on opposite sides of the base frame member and extending in an upward direction, and the knee pad mounting bar extending between the two side frame members and across the front edge of the platform, wherein the knee pad assembly is attached to the knee pad mounting bar.

13. The exercise machine of claim 6, wherein the knee pad assembly comprises a toe and heel support attached to a top portion of the knee pad assembly.

14. A method of performing an exercise comprising the steps of:

orienting a user body prone against a body support assembly, wherein the body support assembly is pivotally engaged with an exercise machine frame, the body support assembly comprising a chest pad assembly comprising a chest pad, an adjustment member, and a chest pad frame, wherein the adjustment member is attached to the chest pad and is in slidable engagement with chest pad frame, such that the chest pad can be positioned at varying distances from the chest pad frame;

positioning a user's legs, such that a lower portion of the user's legs below the knee are stationary;

counter balancing a user's body weight via a counter balance assembly attached to the body support assembly of the exercise machine frame; and moving the user's body from a downward position to a top position by pivoting the body support assembly from a downward position to a top position about the exercise machine frame via the user's knees.

15. The method of claim 14, wherein the step of positioning a user's legs comprises positioning the lower portion of the user's legs and knees against a knee pad assembly attached to the frame.

16. The method of claim 14, further comprising, after the step of moving the user's body from a downward position to a top position, moving the user's body from the top position to the downward position by pivoting the body support assembly from the top position to the downward position about the exercise machine frame via the user's knees.

17. The method of claim 14, wherein the step of counterbalancing the user's body comprises the step of offsetting the user's body weight by adding weight resistance to a weight bearing end of a reaction arm extending away from the body support assembly, the weight bearing end being opposite the body support assembly.

18. The exercise machine of claim 1, wherein the adjustment member is attached to a rear side of the chest pad.

19. The method of claim 14, wherein the adjustment member is attached to a rear side of the chest pad.

20. An exercise machine comprising:

a frame;

a body support assembly in pivotable engagement with the frame;

a knee pad assembly which is connected to the frame, wherein the body support assembly is in pivotable engagement with the knee pad assembly; and a counter balance assembly connected to the body support assembly, wherein, in operation, the body support assembly is pivotable from a downward position to a top position, and the counter balance assembly partially offsets a body weight of a user in a prone position against the body support assembly as the body support assembly is pivoted from the downward position to the top position.

* * * * *